US005756945A

United States Patent [19]

Maeda et al.

[11] Patent Number: 5,756,945

[45] Date of Patent: May 26, 1998

[54] MUFFLER

[75] Inventors: Ituro Maeda, Ichinomiya; Sawami Miyaji, Ama-gun; Hidetoshi Ishihara, Nagoya; Joji Kasugai, Ichinomiya, all of Japan

[73] Assignee: Toyoda Gosei Co., Ltd., Aichi-ken, Japan

[21] Appl. No.: 518,137

[22] Filed: Aug. 22, 1995

[30] Foreign Application Priority Data

| | | | |
|---|---|---|---|
| Aug. 24, 1994 | [JP] | Japan | 6-199821 |
| Feb. 2, 1995 | [JP] | Japan | 7-016246 |
| Feb. 2, 1995 | [JP] | Japan | 7-016247 |

[51] Int. Cl.[6] ..... F01N 1/08

[52] U.S. Cl. ..... 181/272; 181/282; 181/229

[58] Field of Search ..... 181/224, 229, 181/249, 255, 264, 269, 272, 282

[56] References Cited

U.S. PATENT DOCUMENTS

| | | | |
|---|---|---|---|
| 2,675,088 | 4/1954 | McLeod | 181/255 |
| 3,826,332 | 7/1974 | Tuckey | 181/229 |
| 4,368,799 | 1/1983 | Wagner | 181/255 |
| 4,874,062 | 10/1989 | Yanagida et al. | 181/272 X |
| 5,559,308 | 9/1996 | Hayashi | 181/272 X |
| 5,602,368 | 2/1997 | Kaneco | 181/255 |

*Primary Examiner*—Khanh Dang

*Attorney, Agent, or Firm*—Cushman Darby & Cushman IP Group of Pillsbury Madison & Sutro, LLP

[57] ABSTRACT

A muffler includes a box-shaped member formed so as to define an inner space therein, and including at least two communication ports. An inner pipe is accommodated in the box shaped member, and includes a fluid passage formed therein. An end of the inner pipe is installed to one of the communication ports, and another end thereof is installed to another one of the communication ports. A separation is provided in the inner pipe which communicates the fluid passage with the inner space. The inner pipe can include a first tubular member, a part thereof formed integrally with the body by injection molding, and a second tubular member having an end. The end is disposed in the inner space so as to face an end of the first tubular member in spaced relation so as to form the separation. A guide and a fixing member can be formed on an inner wall surface of the body so as to connect the inner pipe with the communication port.

4 Claims, 9 Drawing Sheets

MUFFLER

The priority applications Japanese Patent Application No. 6-199821, filed in Japan on Aug. 24, 1994, Japanese Patent Application No. 7-16246, filed in Japan on Feb. 2, 1995 and Japanese Patent Application No. 7-16247, filed in Japan on Feb. 2, 1995, are hereby incorporated into the present specification by reference.

BACKGROUND OF THE INVENTION

1. Field of the Invention

The present invention relates to a muffler, in particular, a muffler having an expansion chamber. The muffler according to the present invention is appropriate for reducing noises, such as pulsating sounds in an intake system of an automotive combustion engine, or the like.

2. Description of Related Art

When air vibrations arise in an intake system of an automotive combustion engine, or the like and they resonate in an intake hose, noises called intake sounds or pulsating sounds are emitted from an intake port of the intake hose.

As a conventional muffler for reducing these noises, a muffler disclosed in Japanese Examined Patent Publication (KOKOKU) No. 54-40,265 has been known. This muffler comprises a hose having a port opened via a wall surface, and a case formed by blow molding and defining an expansion chamber which covers part of the hose involving the opened port, and to which the port is opened.

In the conventional muffler, the case is formed by blow molding. Blow molding can only form the case into a limited number of configurations. Hence, there arise limitations in the production of the case which can be accommodated in a congested engine room, and which has predetermined performance.

The applicants have invented an intake hose which can inhibit the pulsating noises from arising, and filed a Japanese Patent Application No. 6-88,431. Note that this application was filed on Apr. 26, 1994, and that it is not laid-open on the dates of filing Japanese Patent Application Nos. 6-199,821 and 7-16,246 to which the instant U.S. Patent Application claims the Paris Convention priority.

As illustrated in FIG. 9, the novel intake hose according to Japanese Patent Application No. 6-88,431 comprises a main hose 610 which includes a first hose member 611, a second hose member 612 and a separation 620 formed by disposing the end surfaces of the first and second hose members 611, 612 with a predetermined interval, an outer hose 630 which covers the separation 620, which is disposed on the outer periphery of the main hose 610, and which has an inside diameter larger than the outside diameter of the main hose 610, and a pair of ring shaped members 640, 650 which are disposed between the opposed, ends of the outer hose 630 and the first and second hose members 611, 612, and which respectively bond the outer hose 630 and the first and second hose members 611, 612.

The novel intake hose according to Japanese Patent Application No. 6-88,431 has a tubular enclosed space 660 which is disposed on the outer periphery of the separation 620, and which is formed by the outer hose 630, a pair of the ring shaped members 640, 650 and the main hose 610. In the intake hose, when air is assumed to flow from the first hose member 611 to the second hose member 612, the vibrations of the air flow flowing through the hose member 611 are disturbed by the abrupt expansion of space at the separation 620, and accordingly the resonating sounds arising in the first hose member 611 are disconnected. As a result, the intake hose reduces the pulsating sounds.

SUMMARY OF THE INVENTION

Concerning the novel intake hose according to Japanese Patent Application No. 6-88,431, it has been verified that the larger the volume of the tubular enclosed space 660, the better the noise-inhibiting effect is provided. In addition, it has been also verified that the frequencies of the sounds, whose acoustic pressures can be reduced, depend on the configurations of the tubular enclosed space 660.

Especially, when silence is needed desperately, the inventors of the present invention found out that the outer hose 630 can be made into part of an intake system like a resonator chamber or an expansion chamber, and that the novel intake hose according to Japanese Patent Application No. 688,431 can be developed into a muffler. Thus, they completed a first aspect of a muffler according to the present invention.

In the first embodiment of a muffler according to the present invention, a muffler includes:

a box-shaped member formed so as to define an inner space therein, and including at least two communication ports;

an inner pipe accommodated in the box-shaped member, and including a fluid passage formed therein, an end installed to one of the communication ports, and another end installed to another one of the communication ports; and a separation defined in the inner pipe and communicating the fluid passage with the inner space.

In the first embodiment of the present muffler, the inner pipe is separated by the separation, and is accommodated in the box shaped member. Accordingly, the present muffler operates and effects advantages as follows; namely: the air flowing in the fluid passage formed in the inner pipe suddenly expands at the separation into the inner space formed in the box-shaped member, and thereby the vibrations of the air flowing in the fluid passage are disturbed. In other words, since the resonating sounds arising at the inside of the inner pipe are disconnected at the separation, this muffler can reduce the irritating noises like the pulsating sounds.

This muffler can be manufactured in the following manner. First, the inner pipe including the separation is formed. Then, in a mold which is prepared so as to form the box-shaped member, for instance, in a mold adapted for blow molding the box-shaped member, an end of the inner pipe is disposed at a first predetermined position, the end which is to be installed to one of the communication ports, and another end of the inner pipe is disposed at a second portion, the end which is to be installed to another one of the communication ports. Thereafter, the mold is closed to carry out blow molding. This muffler is thus completed.

However, when the first embodiment of the present hose is manufactured by the aforementioned manufacturing process, it is difficult to accomplish disposing an end of the inner pipe at a first predetermined position, disposing another end of the inner pipe at a second predetermined position, and forming a predetermined separation.

Specifically, the first predetermined position and the second predetermined position determine the curvature of the fluid passage which is formed in the inner hose. Accordingly, when the opposite ends of the inner hose are not fixed appropriately at the predetermined positions, the fluid passage is formed so that it deviates from the configuration which can flow fluid smoothly, and thus its fluidic resistance increases. As a result, there may arise another cause for producing unprecedented noises. Moreover, the separation is not formed to a predetermined size, and consequently there may arise a fear that no satisfactory noise-reduction effect can be expected.

In blow molding, even when the opposite ends of the inner hose are fixed appropriately at the predetermined positions, the opposite ends of the inner hose might be displaced slightly after molding. Further, it is hard to adjust the positions of the opposite ends of the inner hose after molding. Consequently, in this type of muffler, which has reduced fluidic resistance and produces a predetermined noise-reduction effect, is manufactured by blow molding, the difficulty of the manufacturing operations might increase, and the man-power requirements and the manufacturing costs therefor might increase considerably.

Hence, in a second and third embodiment of a muffler according to the present invention hereinafter described, it is a primary object thereof to provide a muffler whose manufacturing operations are simplified and number of component parts are decreased without impairing the reduced fluidic resistance against intake air and the superb noise-reduction effect provided by the first embodiment of the present hose.

In the second embodiment of a muffler according to the present invention, a muffler includes:

a body formed integrally by injection molding so as to define a part of an inner space therein, and including a first tubular portion having opposite ends, one end opened to the inner space and the other end opened to the outside, and an installation port communicating the inner space with the outside;

an enclosure member bonded to the body, and formed by injection molding so as to define a remainder of the inner space therein; and a second tubular member having opposite opened ends, one end disposed in the inner space so as to face the one end of the first tubular portion in spaced relation and the other end installed to the installation port of the body.

In the second embodiment of the present muffler, at least one of the body and the enclosure member can include an internal fixing member for fixing an end portion of the second tubular member in the inner space.

Further, in the second embodiment of the present muffler, at least one of the body and the enclosure member can include a separator wall portion which separates the inner space into an expansion chamber and a resonator chamber, the expansion chamber accommodating the end portion of the first tubular portion and the end of the second tubular member therein, and the resonator chamber neighboring the other end of the first tubular portion; and the first tubular portion can include a resonator port opened to the resonator chamber.

Note that, in the present muffler, the resonator port can be a small-diameter hole, a small-diameter pipe, and so on.

In the second embodiment of the present muffler, the first tubular portion, formed integrally with the body, is a part of an inlet hose member which is divided by an interval operating as the separator, and the second tubular member is the other part of the inlet hose member. The body and the enclosure member are bonded to each other, thereby forming the inner space which accommodates the separator, working as an expansion port for inlet air, therein. The inlet air passing through the first tubular portion and the second tubular member expands into the inner space through the separator, thereby damping the vibrational components, resonating with the first tubular portion or the second tubular member, in the inlet air.

This muffler can be manufactured as follows; namely: an end of the second tubular member is disposed so as to face an end of the first tubular portion with an interval provided therebetween, and another end thereof is engaged with the installation port. Then, the enclosure member is connected to the body with the thus assembled second tubular member.

In this muffler, the first tubular portion is formed integrally with the body by injection molding. Hence, the first tubular portion can be considered to be fixed at a predetermined position. Specifically, in this muffler, it is possible to form an inlet passage having reduced fluidic resistance against inlet air by positionally adjusting the second tubular member with respect to the first tubular portion, the datum. In other words, the second tubular member can be disposed with respect to the first tubular portion with a predetermined curvature. Moreover, since the interval between an end of the first tubular portion and an end of the second tubular member can be adjusted with ease, it is possible to produce a favorable noise-reduction effect.

As having been described so far, the second embodiment of the present muffler can be manufactured by the extremely simple assembling operations; namely: the second tubular member is assembled with the body which includes the first tubular portion formed integrally by injection molding. Thereafter, the enclosure member is bonded to the body with the second tubular member assembled. Further, by simply positioning the second tubular member with respect to the first tubular portion whose position is fixed, the fluidic resistance against inlet air can be reduced, and a satisfactory noise-reduction effect can be attained. As a result, the man-hour requirements for manufacturing this muffler can be reduced remarkably.

In the second embodiment of the present muffler, when at least one of the body and the enclosure member includes an internal fixing member, the internal fixing member positions an end of the second tubular member for fixing. Accordingly, simultaneously with the assembly of the second tubular member, the assembly of the first tubular portion and the second tubular member can be adjusted to a state in which the fluidic resistance against inlet air is reduced and a good noise-reduction effect is provided. As a result, the man-hour requirements for manufacturing this muffler can be further reduced.

In the second embodiment of the present muffler, when at least one of the body and the enclosure member includes a separator wall portion which separates the inner space into an expansion chamber and a resonator chamber, and when the first tubular portion includes a resonator port opened to the resonator chamber, not only it is possible to produce the noise-reduction effect which is effected by expanding the inlet air, traveling through the first tubular portion and the second tubular member, into the inner space through the separator, but it is also possible to produce a noise-reduction effect which results from noise-damping caused by resonating the vibrational components, corresponding with the volume of the resonator chamber, via the resonator port. Specifically, even when an expansion chamber and a resonator chamber are provided at the same time, the number of component parts does not increase significantly in this muffler. As a result, it is possible to cut down on the manufacturing costs of this muffler which produces an excellent noise-reduction effect by the synergetic effect stemming from the expansion principle and the resonance principle.

When manufacturing the second embodiment of the present muffler, it is desired, after facing the opened end of the second tubular member with the end of the first tubular portion opened to the inner space, to axially align them accurately and to adjust the interval therebetween. When they are axially aligned accurately, fluidic resistance can be inhibited from arising excessively, and pressure loss can be controlled. When the separator between them is adjusted to a predetermined interval, a predetermined noise-reduction effect can be produced. However, these operations result in increasing the man-hour requirements and costs for manufacturing the present muffler.

Hence, when assembling the third embodiment of the present muffler hereinafter described, the following operations no longer required; namely: the operation for axially aligning the first tubular portion and the second tubular member which are to be disposed in the expansion chamber, and the operation for adjusting the interval of the separator formed between the first tubular portion and the second tubular member. Specifically, in the third embodiment of the present muffler, a muffler is established in which an inner pipe has been positioned in advance prior to the assembling operations. The inner pipe has a separation which is formed accurately as designed. Moreover, when assembling this muffler, the inner pipe having the separation can be disposed therein by snap action.

The third embodiment of the present muffler includes:

a box-shaped member formed so as to define an expansion chamber therein, and including a plurality of wall surfaces, and communication ports penetrating at least two of the wall surfaces;

an inner pipe including openings at opposite ends, the openings at opposite ends respectively communicating with the communication ports and being connected to the wall surfaces surrounding the communication ports, and a separation defined in the inner pipe communicating with the expansion chamber;

a guide disposed on the wall surfaces so as to surround the communication, ports, the guide guiding the opposite ends of the inner pipe along the wall surfaces; and a fixing member disposed on the wall surfaces so as to fix the opposite ends on the wall surfaces.

In the third embodiment of the present muffler, the separation, which is opened to the expansion chamber, has been already formed in part of the inner tube. In other words, prior to the assembling operations of this muffler, a predetermined separation has been formed accurately in the inner pipe in advance. Accordingly, it is unnecessary to adjust the interval of the separation and to axially align the separation.

Further, when assembling the inner pipe within the box shaped member, the guides disposed on the wall surfaces of the box-shaped member engage with the ends of the inner pipe to guide and hold them at predetermined positions. At the same time, the fixing members disposed on the wall surfaces of the box-shaped member fix the ends of the inner pipe. To put it differently, the inner pipe having the separation can be assembled by snap action, and thereby the assembling operations of this muffler can be simplified remarkably. Accordingly, the man-hour requirements and costs for manufacturing this muffler can be reduced further. As a result, it is possible to provide a muffler, which exhibits reduced fluid passage resistance and produces a predetermined, excellent noise-reduction effect, at less cost.

The assembling operations of the third embodiment of the present muffler can be furthermore reduced as hereinafter described. For instance, in the third embodiment of the present muffler, the openings at opposite ends of the inner pipe can include a flange working as a guide portion to be guided, and the guide disposed on the wall surfaces can be a guide groove capable of engaging with the flange.

In the third embodiment of the present muffler having the extra arrangements, the flange disposed on the opposite ends of the inner pipe engages with the guide groove disposed on the wall surfaces of the box-shaped member. Accordingly, the ends of the inner pipe are held and fixed accurately and firmly at predetermined positions on the wall surfaces of the box-shaped member as designed. Moreover, when assembling the inner pipe, the guide grooves guide the flanges. Specifically, by fitting the flanges into the guide grooves and sliding them in one direction, the assembling operation of the inner pipe can be completed. Thus, in this muffler, the assembling operation of the inner pipe scarcely requires skill, and it is simplified extremely. Hence, the man-hour requirements for manufacturing this muffler is furthermore reduced.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which form a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Embodiment

Figure 1:
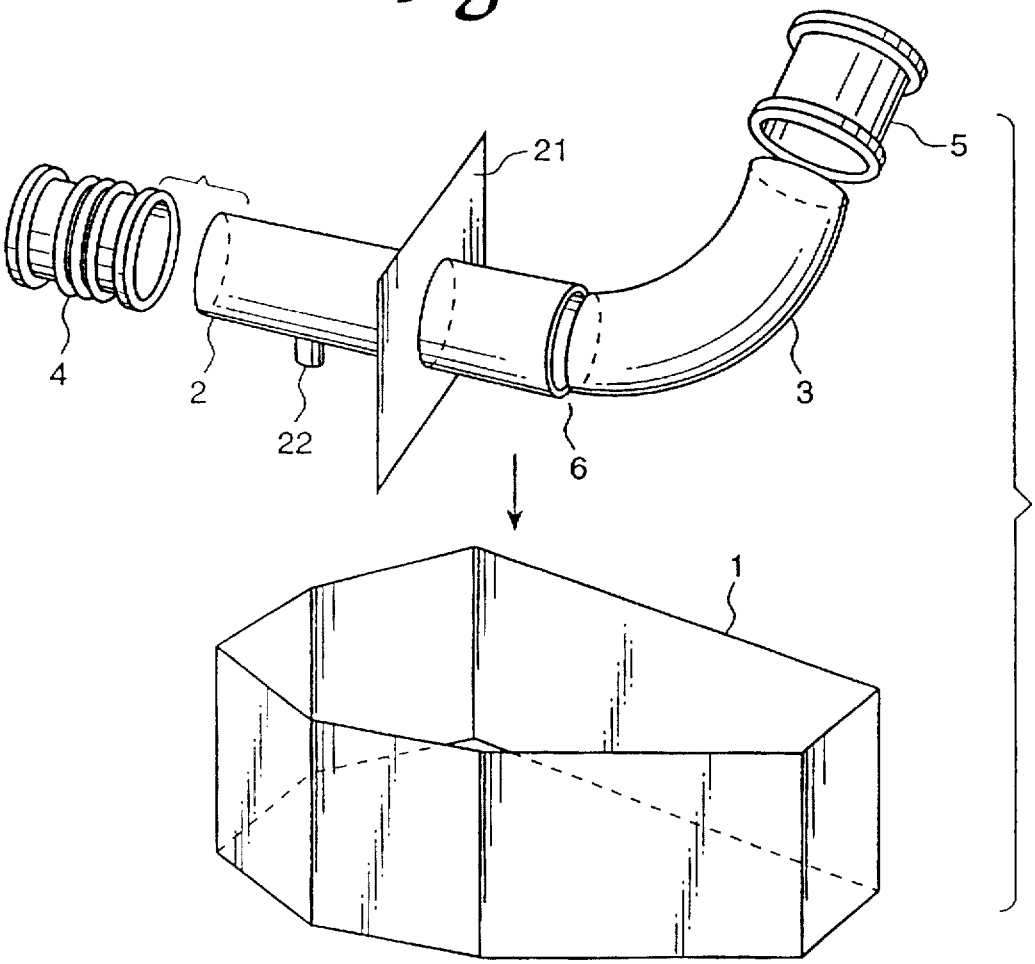
FIG. 1 is an exploded perspective view illustrating a First Embodiment of a muffler according to the present invention.

A First Embodiment of a muffler according to the present invention will be hereinafter described with reference to FIG. 1. FIG. 1 is an exploded perspective view illustrating the First Embodiment of the present muffler.

As illustrated in FIG. 1, in the First Embodiment of the present muffler, an inlet hose comprises a first hose member 2 and a second hose member 3, and has a separation 6 which is formed by facing end surfaces of the first and second hose members 2 and 3 with a predetermined separation interval. The inlet hose is disposed so as to extend in a space 1 which is formed by a box-shaped contour member. In this muffler, the space 1 is divided by a partition plate 21 into an expansion space which is communicated with the separation 6, and a resonator chamber. The resonator chamber is formed around the outer periphery of the first hose member 2, and accordingly the partition plate 21 is formed like a flange at an intermediate portion of the first hose member 2. In order to communicate a passage, formed in the first hose member 2, with the resonator chamber, a small-diameter pipe 22 is formed in the first hose member 2 which is to be placed in the resonator chamber. The first hose member 2 is connected to an air cleaner (not shown) via a resilient hose 4, and the second hose member 3 is connected to an engine (not shown) via a resilient hose 5.

When manufacturing the thus constructed muffler, the box shaped contour member having the space 1 therein is formed by blow molding. For instance, one can think of the following manufacturing process; namely: in a mold adapted for blow molding the box-shaped contour member, the first hose member 2, the second hose member 3 and the partition plate 21 are assembled as illustrated in FIG. 1, and thereafter the box shaped contour member is blow-molded.

However, in the manufacturing process, it is difficult to fit the first hose member 2 with the partition plate 21 assembled, and the second hose member 3 into a mold adapted for blow molding the box-shaped contour member in the state illustrated in FIG. 1.

Specifically, the positions of the first and second hose members 2, 3 determine the curvature of an inlet air passage. Hence, when the positions of the first and second hose members 2, 3 are not fixed appropriately, the inlet air passage may deviate from a configuration which allows the inlet air to flow smoothly, its resistance against inlet air may increase, and unprecedented noises may occur. Further, the size of the separation 6 may not be identical around the entire peripheries of the facing ends of the first and second hose members 2, 3, and accordingly, a satisfactory noise-reduction effect may not be expected.

In addition, it is desired to fix the first and second hose members 2, 3 at appropriate positions. However, in blow molding, even if the positions of the first and second hose members 2, 3 are controlled in a mold prior to molding, their positions may be displaced slightly after molding. It is much more difficult to adjust their positions after molding. Thus, when manufacturing the muffler having reduced resistance against inlet air and capable of producing a good noise reduction effect as illustrated in FIG. 1 by blow molding, there arises a fear for increasing the man-hour requirements for the manufacturing operations.

Second Embodiment

Figure 2:
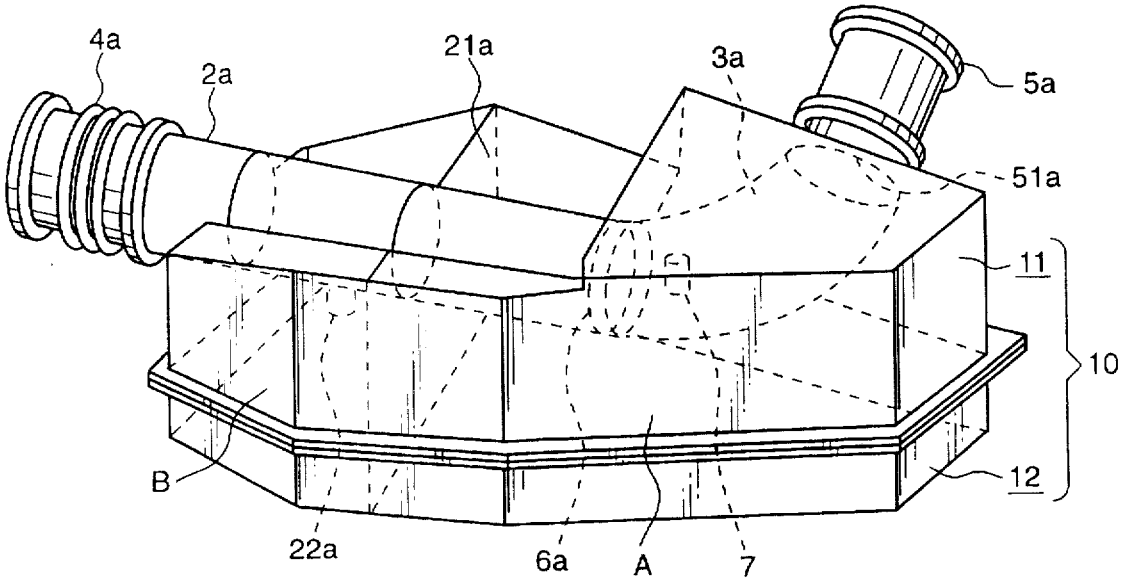
FIG. 2 is a schematic perspective view illustrating a Second Embodiment of a muffler according to the present invention.
Figure 3:
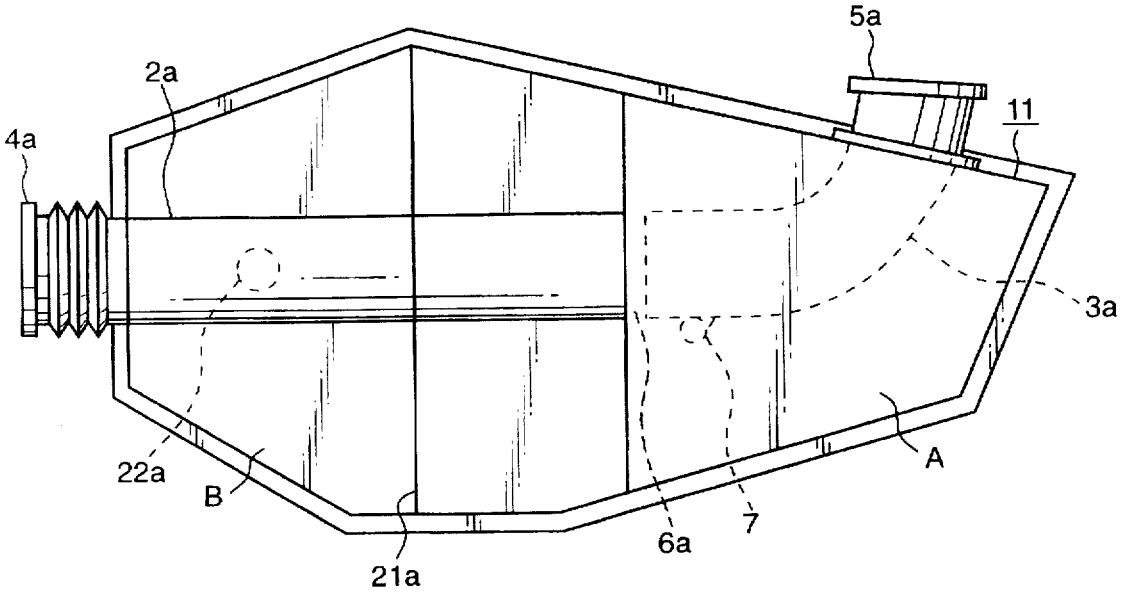
FIG. 3 is a plan view of the Second Embodiment of the present muffler.
Figure 4:
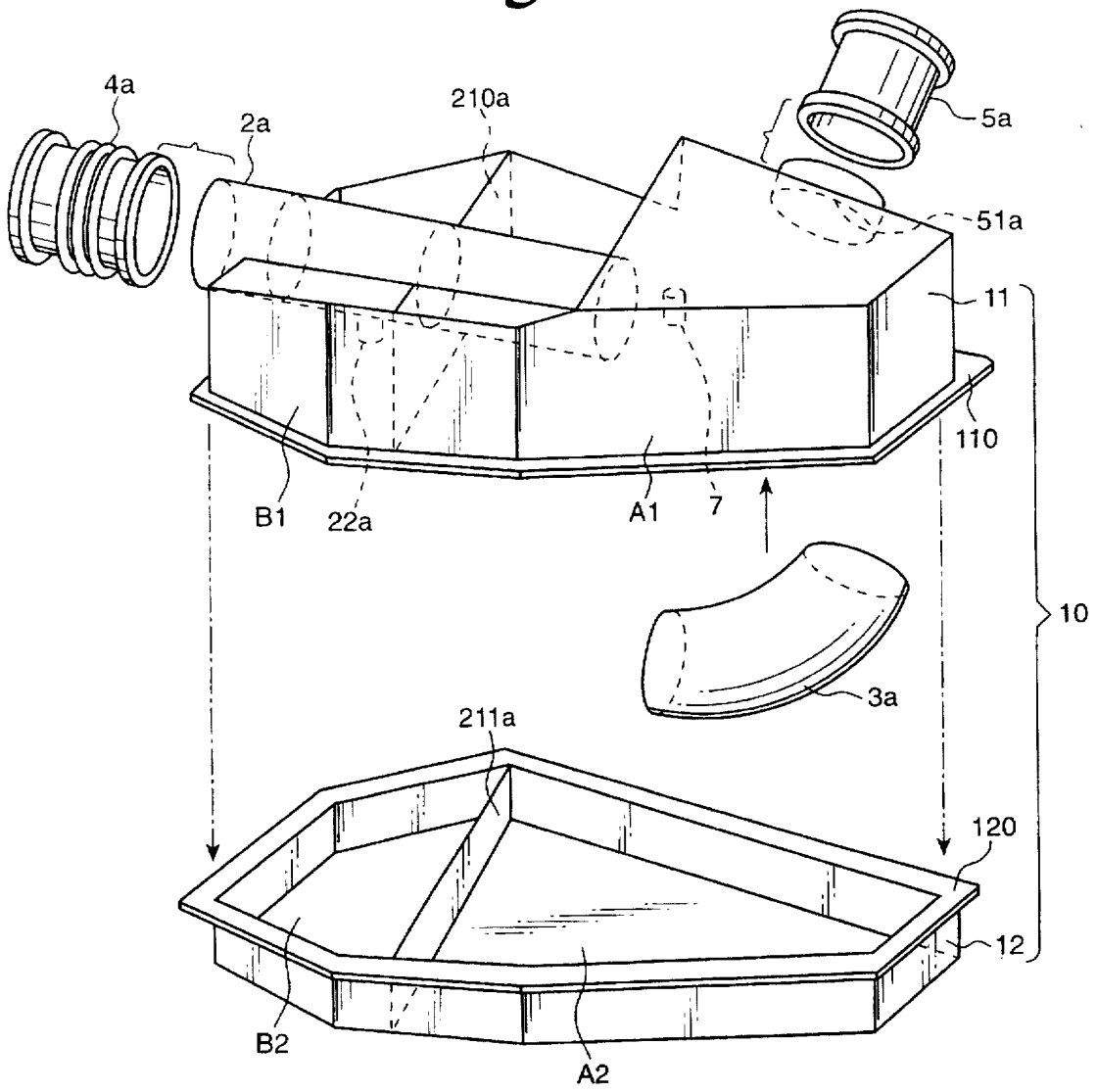
FIG. 4 is an exploded perspective view of the Second Embodiment of the present muffler.

A Second Embodiment of the present muffler has been developed in order to solve the problems which may stem from the First Embodiment of the present muffler. FIG. 2 is a schematic perspective view illustrating the Second Embodiment of the present muffler. FIG. 3 is a plan view of the Second Embodiment of the present muffler. FIG. 4 is an exploded perspective view of the Second Embodiment of the present muffler.

As illustrated in FIGS. 2 and 3, the Second Embodiment of the present muffler includes a container 10 constituting the contour of the present muffler, a first tubular portion 2*a* extending in an inner space in the container 10, and a second tubular member 3*a* also extending therein. The first tubular portion 2*a* and the second tubular member 3*a* respectively correspond to the first tube member 2 and the second tube member 3 of the present muffler illustrated in FIG. 1 which motivated the present inventors to develop the Second Embodiment of the present muffler.

An end of the first tubular portion 2*a* and an end of the second tubular member 3*a* are disposed so as to face each other with a predetermined separation interval, thereby forming a separation 6*a*. The separation 6*a* communicates with an inlet air passage which is formed in the first tubular portion 2*a* and the second tubular member 3*a*.

In the Second Embodiment of the present muffler, the inner space is divided into two parts by forming a partition wall portion 21*a* at an intermediate portion of the first tubular portion 2*a*. The partition wall portion 21*a* crosses perpendicularly with a horizontal cross-sectional plane containing the axis of the first tubular portion 2*a*. Specifically, part of the inner space communicating with the separation 6*a* is adapted to be an expansion chamber "A", and the other part of the inner space not communicating with the separation 6*a* is adapted to be a resonator chamber "B". The resonator chamber "B" communicates with the inlet air passage, constituted by the first tubular portion 2*a*, via a small diameter pipe 22*a* formed in the first tubular portion 2*a*.

As illustrated in FIG. 4, the container 10 is made by connecting a body 11 and an enclosure member 12. The body 11 is formed as concavity to define part of the inner space. The enclosure member 12 is formed as concavity to define the rest of the inner space.

The first tubular portion 2*a* is formed integrally with the body 11 by injection molding. Part of the first tubular portion 2*a* is shared by part of the body 11, thereby making a duplex construction. An end of the first tubular portion 2*a* constituting the separation 6*a* is opened to the inner space (e.g., the expansion chamber "A"). The other end of the first tubular portion 2*a* is formed to project from a side surface of the body 11, and is connected with a resilient hose 4*a*. Thus, the Second Embodiment of the present muffler can be connected with an air cleaner (not shown) via the resilient hose 4*a*.

The second tubular member 3*a* is fixed at an end portion, for example, by welding, with an internal fixing member 7 which is formed to project from an upper wall surface of the body 11, and is fitted into an installation port 51*a* at the other end portion. The installation port 51*a* which is opened in another side surface of the body 11. A bank-shaped portion is formed around the installation port 51*a* engaged with the other end portion of the second tubular portion 3*a*, and connected with a resilient hose 5*a*. Thus, the Second Embodiment of the present hose can be connected with an engine (not shown) via the resilient hose 5*a*.

A dam-shaped portion 210*a* is formed at a predetermined position on the body 11. This position corresponds to an intermediate portion of the first tubular portion 2*a*. The dam shaped portion 210*a* constitutes part of the partition wall portion 21*a*. Likewise, a dam-shaped portion 211*a* is formed at a predetermined position on the enclosure member 12. The dam shaped portion 211*a* a matches with the dam-shaped portion 210*a*, and constitutes the rest of the partition wall portion 21*a*.

In the thus constructed Second Embodiment of the present muffler, inlet air flowing in the first tubular portion 2*a* leaks into the resonator chamber "B" by way of the small diameter pipe 22*a*. As a result, the vibrational components of the inlet air are dampened, vibrational components which resonate with the volume of the resonator chamber "B".

Further, the inlet air flowing in the first tubular portion 2*a* expands into the expansion chamber "A" via the separation 6*a*. As a result, the vibrational components of the inlet air are dampened, vibrational components which resonate with the first tubular portion 2*a* or the second tubular member 3*a*.

The Second Embodiment of the present muffler includes the body 11, the enclosure member 12 and the second tubular member 3*a* as its major components. Thus, this muffler requires a reduced number of component parts, and can be manufactured with ease by simply molding the reduced number of component parts and assembling them together.

For example, the second tubular member 3*a* can be formed by blow molding. The body 11, involving the first tubular portion 2*a*, and the enclosure member 12 can be formed by injection molding. Then, the second tubular member 3*a* is welded to the internal fixing member 7 at an end portion, and fitted into the installation port 51*a* of the body 11 at the other end portion, thereby completing the assembly of the second tubular member 3*a* within the body 11. Finally, a rim portion 110 of the body 11 is bonded to a rim portion 120 of the enclosure member 12, for instance, by welding, thereby completing the Second Embodiment of the present muffler.

As having been described so far, in the Second Embodiment of the present muffler, the first tubular portion 2*a* is positionally fixed because it is formed integrally with the body 11. An inlet air passage having reduced resistance against inlet air can be formed with ease by positionally adjusting the second tubular member 3*a* with respect to the first tubular portion 2*a* whose position is fixed, and by securing it in place in the body 11. In other words, the second tubular member 3*a* can be disposed easily with a predetermined curvature with respect to the first tubular portion 2*a*. In addition, the adjustment on the size of the separation 6*a* can be carried out with ease to produce a better noise-reduction effect.

In particular, in the Second Embodiment of the present muffler, the internal fixing member controls the second tubular member 3*a* in terms of the assembly position with respect to the body 11 when installing the second tubular member 3*a* within the body 11. Accordingly, in this muffler, it is unnecessary to adjust the assembled state of the second tubular member 3*a* so as to reduce resistance against inlet air and produce a good noise-reduction effect.

Figure 5:
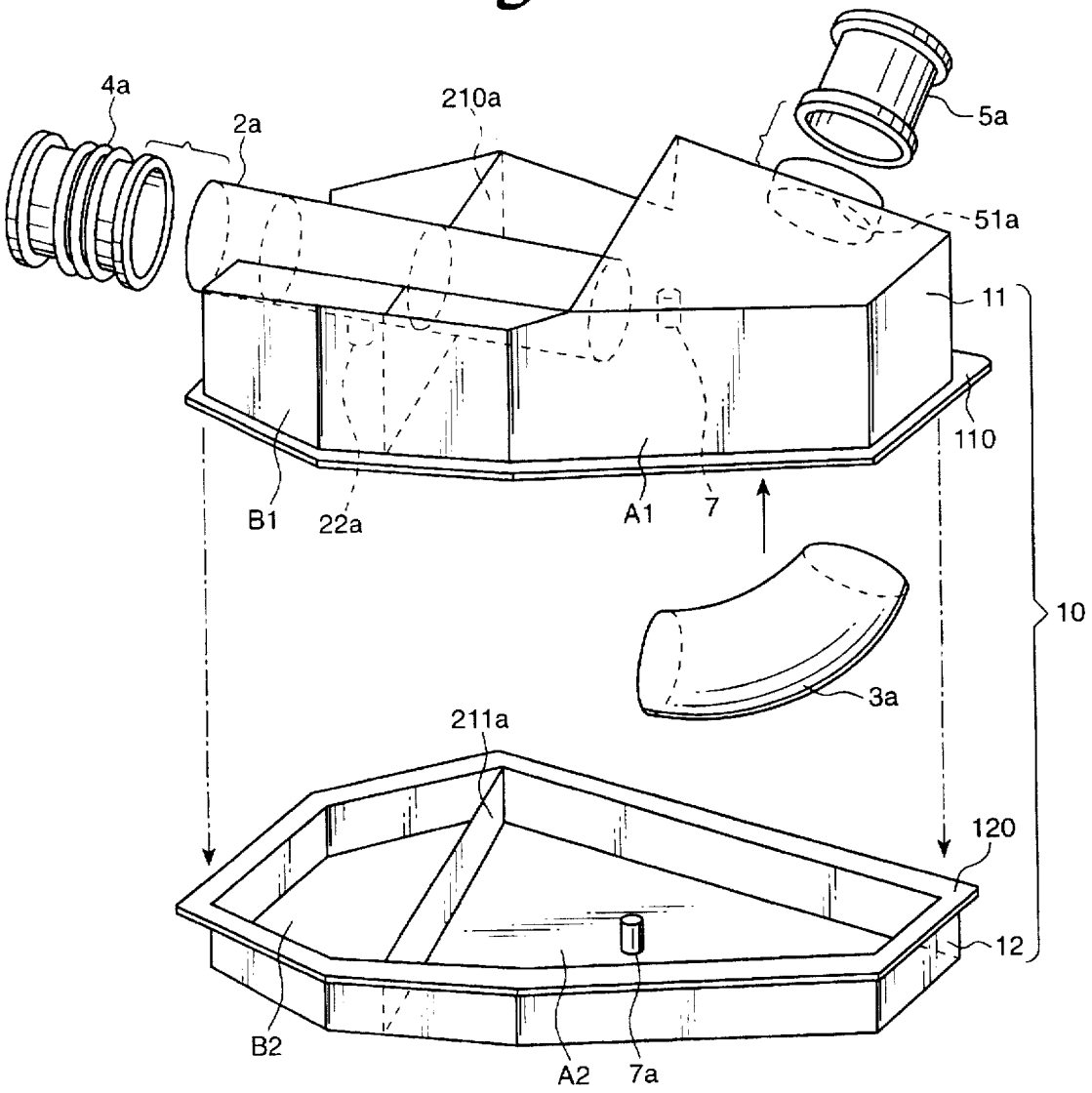
FIG. 5 is an exploded perspective view of a modified version of the Second Embodiment of the present muffler.

In the Second Embodiment of the present muffler, the internal fixing member 7 is disposed on the body 11. However, in a modified version of this muffler illustrated in FIG. 5, an internal fixing member 7*a* can be disposed on the enclosure member 12. The thus constructed modified version can produce the same advantages as the Second Embodiment of the present muffler.

As another modified version of the Second Embodiment of the present muffler, one can think of a simplified muffler in which the inner space is adapted to be the expansion chamber "A" alone by obviating the partition wall portion 21*a*. However, in accordance with the Second Embodiment of the present muffler, it is possible to easily provide a partition wall portion, which can produce the synergetic noise-reduction effect by the inlet air resonance with the resonator chamber "B" as well as the expansion noise-reduction effect by the inlet air expansion into the expansion chamber "A," not by preparing independent component parts, but by molding integrally. Hence, it is further preferred to improve the constructions of the Second Embodiment of the present muffler.

Third Embodiment

Figure 6:
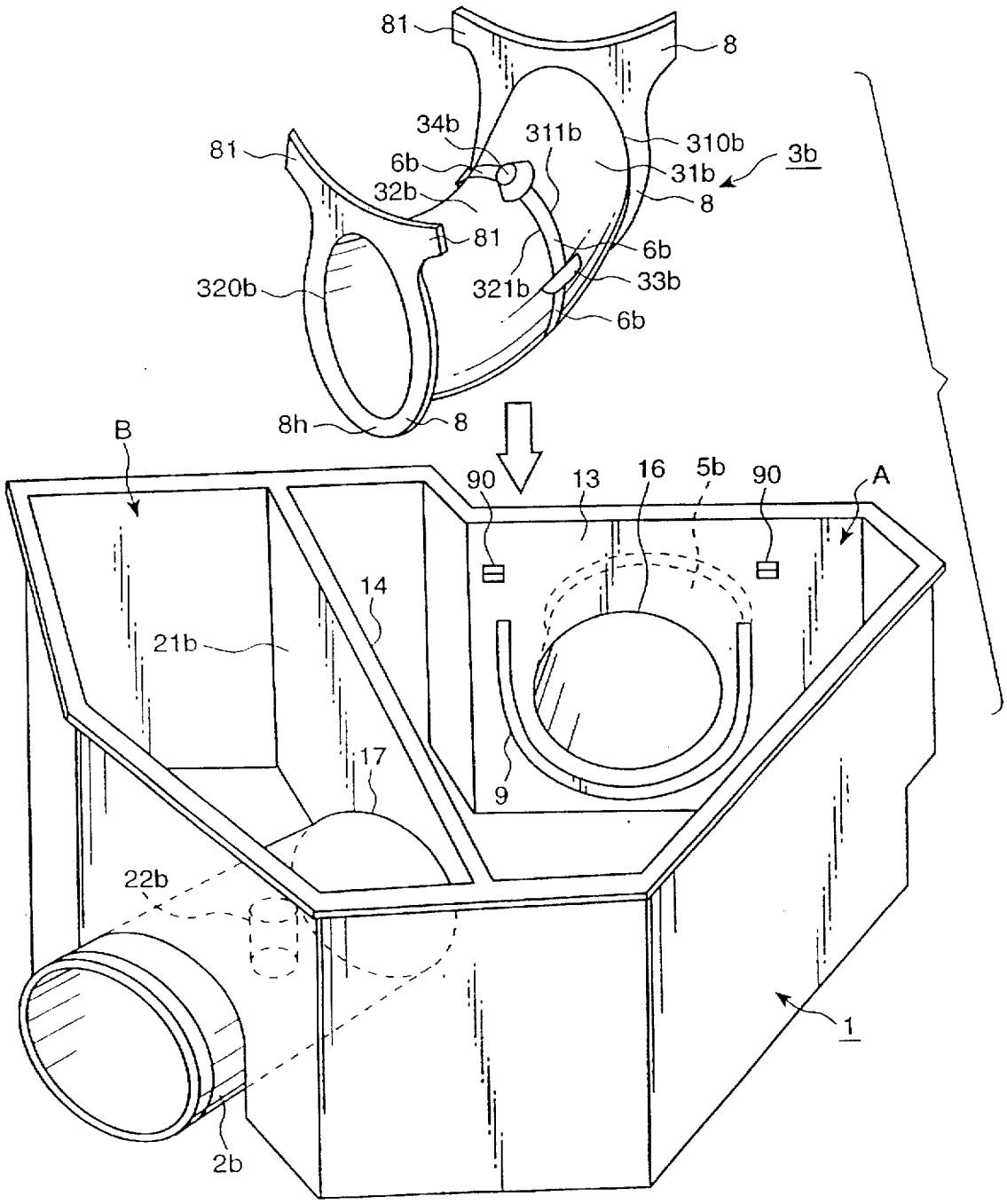
FIG. 6 is a perspective view illustrating major constructions of a Third Embodiment of a muffler according to the present invention, and assembling operations thereof.
Figure 7:
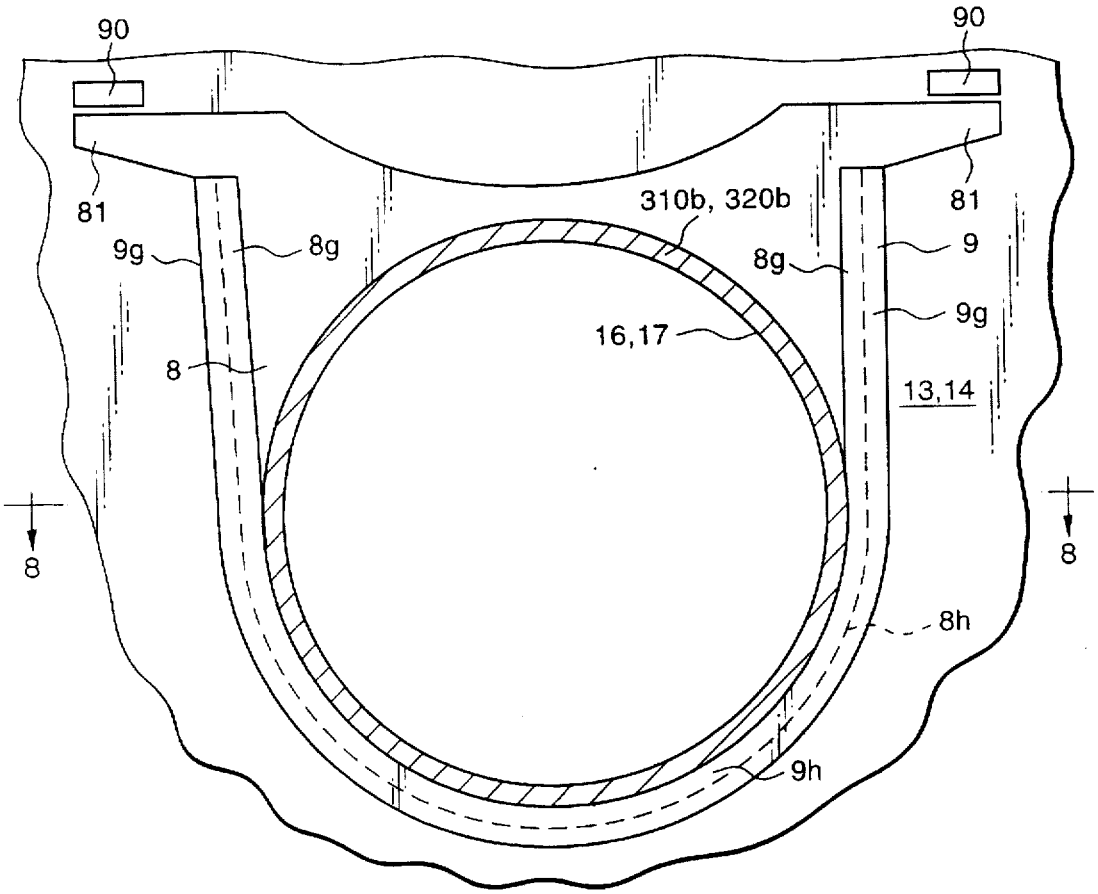
FIG. 7 is a cross-sectional view illustrating engagements between a flange and a guide and between a flange and fixing members in the Third Embodiment of the present muffler.
Figure 8:
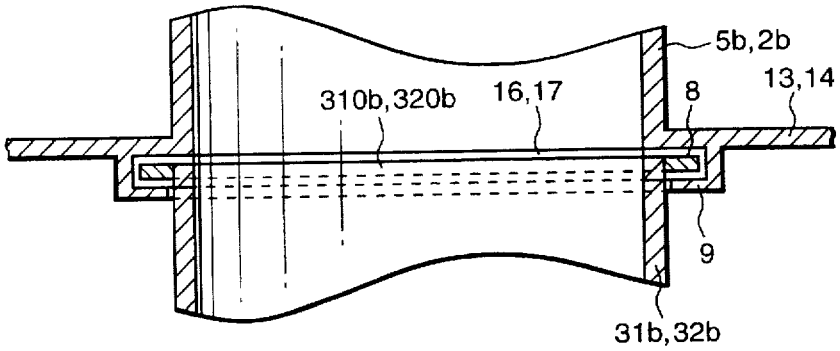
FIG. 8 a cross-sectional view illustrating an engagement around the guide groove in the Third Embodiment of the present muffler, and taken along line 8—8 of FIG. 7.
Figure 9:
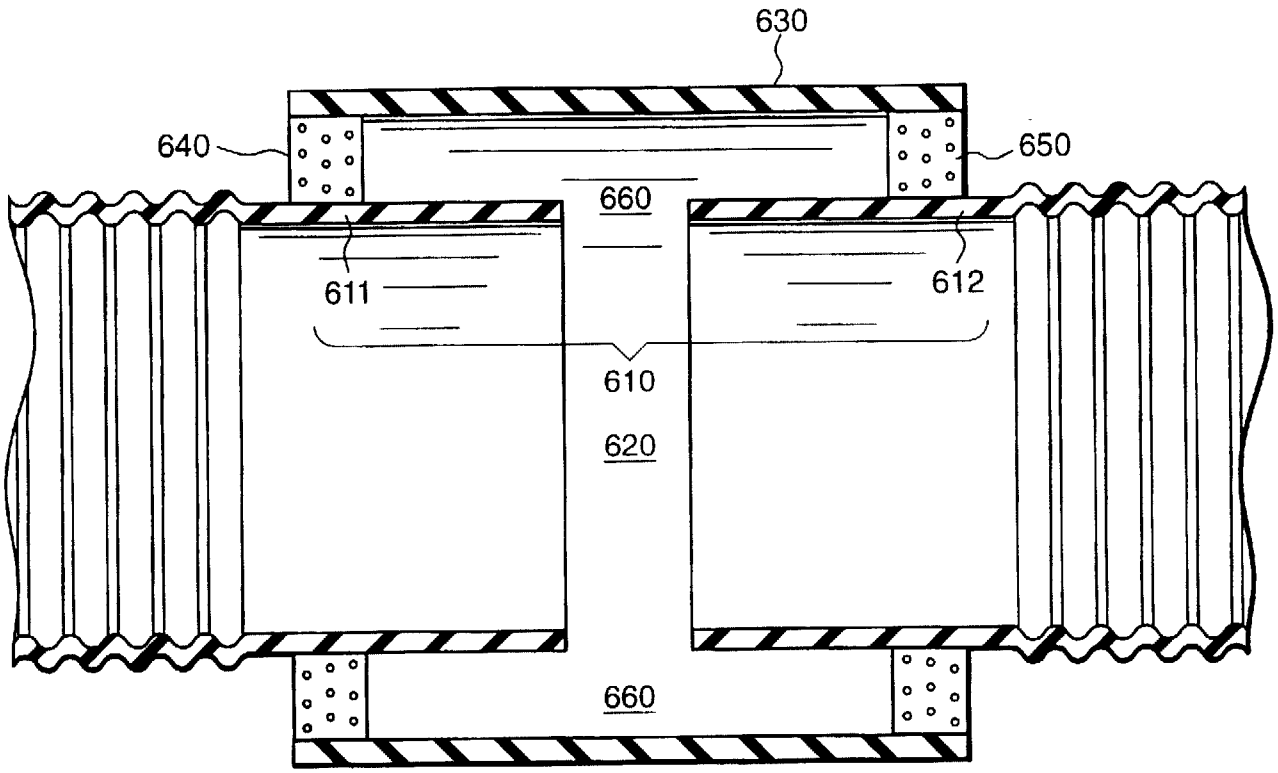
FIG. 9 is a cross-sectional view of an inlet hose which was disclosed in Japanese Patent Application No. 6-88431.

A Third Embodiment of the present muffler will be hereinafter described with reference to FIGS. 6 through 8. FIG. 6 is a perspective view illustrating major constructions of the Third Embodiment of present muffler, and assembling operations thereof. FIG. 7 is a cross-sectional view illustrating engagements between a flange and a guide and between a flange and fixing members in the Third Embodiment of the present muffler. FIG. 8 is a cross sectional view illustrating an engagement around the guide groove in the Third Embodiment of the present muffler, and taken along line 8—8 of FIG. 7.

As illustrated in FIG. 6, the Third Embodiment of the present muffler includes a box-shaped member 1 which is formed by injection molding and which defines an expansion chamber "A" and resonator chamber "B" therein, and an inner pipe 3*b* which is opened at opposite ends.

The box-shaped member 1 has wall surfaces 13, 14. The wall surfaces 13, 14 have communication ports 16, 17, respectively. The wall surfaces 13, 14 surrounding the communication ports 16, 17 of the box-shaped member 1 are provided with guide grooves 9 which engage with ends 310*b*, 320*b* of the inner pipe 3*b* to guide them on the wall surfaces 13, 14 as hereinafter described, and fixing members 90, 90 which fix the ends 310*b*, 320*b*. Note that the guide groove 9 and the fixing members 90, 90 on the wall surface 14 are not shown for clarity of illustration. The guide groves 9, 9 of the box-shaped member 1 are formed so as to be capable of engaging with flanges 8, 8 which are provided on the ends 310*b*, 320*b* of the inner pipe 3*b*.

The inner pipe 3*b* is formed partially by injection molding, and is constructed by connecting its component parts. The inner pipe 3*b* includes the opposite ends 310*b*, 320*b* which are opened, and a plurality of separations 6*b* which are formed virtually at the intermediate portion and are opened to the expansion chamber "A". The ends 310*b*, 320*b* of the inner pipe 3 are communicated respectively with the communication ports 16, 17, and are connected respectively with the wall surfaces 13, 14 surrounding the communication ports 16, 17 to be fixed thereon. Moreover, the ends 310*b*, 320*b* of the inner pipe 3*b* are provided with the flanges 8, 8 which respectively operate as a guide portion to be guided.

In the Third Embodiment of the present muffler, the inner pipe 3*b* is fixed in the expansion chamber "A" formed by the box-shaped member 1, and a cover plate (not shown) is welded to the entire periphery of the box-shaped member 1 and an edge of the partition wall 21*b*. Thus, the Third Embodiment constitutes a muffler that has an enclosed expansion chamber "A" and an enclosed resonator chamber "B".

Specifically, in the Third Embodiment of the present muffler, the box-shaped member 1 includes a bottom plate having an intricate configuration, side walls standing around the bottom plate perpendicularly therewith, and the partition wall 21*b* dividing the inner space, formed by the bottom plate and side walls, into the expansion chamber "A" and the resonator chamber "B". Further, in the Third Embodiment of the present muffler, a straight tubular member 2b is disposed so as to penetrate one of the side walls forming the resonator chamber "B" and to cross the resonator chamber "B". One end of the straight tubular member 2b is bonded to the partition wall 21b to open on the wall surface 14 and to constitute the communication port 17, and the other end thereof is projected from the side wall to the outside of the box shaped member 1. On the periphery of the projected end of the straight tubular member 2b, there is formed an engager projection. This engager projection constitutes an opened end adapted for connection. Moreover, the straight tubular member 2b has a small-diameter pipe 22b at an intermediate portion in its cylindrical wall. Thus, the straight tubular member 2b constitutes a Helmholtz type resonator chamber by communicating the fluid passage formed therein with the resonator chamber "B" via the small-diameter pipe 22b.

Another communication tubular member 5b is disposed so as to project from another wall surface of the expansion chamber "A" of the box-shaped member 1 to the outside thereof. On the periphery of the projected end of the communication tubular member 5b, there is formed an engager projection. This engager projection constitutes an opened end adapted for connection. The other end of the communication tubular member 5b is bonded to the wall surface 13 forming the expansion chamber "A" to open to the expansion chamber "A" and to constitute the communication port 16.

On the wall surfaces 13, 14 around the two communication ports 16, 17 opened to the expansion chamber "A," there is disposed "U"-shaped guide grooves 9, 9 which are opened toward the cover plate, respectively. Further, on the wall surfaces 13, 14, there are disposed a pair of fixing members 90, 90 so as to project into the expansion chamber "A". The fixing members 90, 90 are placed at a predetermined distance away from the right and left ends of the "U"-shaped guide grooves 9, 9 which are opened upwardly in FIG. 6 toward the cover plate, respectively. The fixing members 90, 90 are formed as a rectangle-shaped projection. Note that, since the guide groove 9 and the fixing members 90, 90 provided on the wall surface 14 are identical with those provided on the wall surface 13, they are not illustrated in FIG. 6. Hereinafter, the flanges 8, 8 will be described, flanges which are provided at the ends 310b, 320b of the inner pipe 3b. The arrangements of the guide grooves 9, 9 and the fixing members 90, 90, and the advantages resulting therefrom will be discussed in detail below.

As illustrated in FIG. 6, the inner pipe 3b is to be assembled within the expansion chamber "A" of the box-shaped member 1. It comprises two curved pipes 31b, 32b which are connected so as to provide an interval therebetween and to form the separations 6b at a middle portion, and the flanges 8, 8 which are fixed at the ends 310b, 320b respectively. At the separations 6b formed like a slit, the two curved pipes 31b, 32b are disposed so as to provide a predetermined interval between their opened ends 311b, 321b, and they are connected integrally by a plurality of connectors 33band 34b so as to be axially aligned.

As illustrated in FIGS. 7 and 8, at the connections between the box-shaped member 1 and the inner pipe 3b, the flanges 8, 8 provided at the ends 310b, 320b of the inner pipe 3b are fitted in the "U"-shaped guide groves 9, 9 to be secured in place. As mentioned earlier, the guide grooves 9, 9 are disposed around the two communication ports 16, 17 which are formed in the wall surfaces 13, 14 within the box-shaped member 1.

As illustrated in FIG. 8, the guide grooves 9, 9 include projections having an "L"-shaped cross-section. The projections project from the wall surfaces 13, 14 so as to form grooves, which are to be engaged with the flanges 8, 8 and which have a rectangle-shaped cross-section, between themselves and the wall surfaces 13, 14. As illustrated in FIG. 7, the guide grooves 9, 9 include a supporting portion 9h, and a pair of guiding portions 9g, 9g which extend upwardly in FIG. 7 continuously from the opposite ends of the supporting portion 9h. The supporting portion 9h is formed as an arc shape so that it goes around the lower half of the communication ports 16, 17. The guiding portions 9g, 9g extend up to positions which are placed above the top of the communication ports 16, 17, and terminate thereat to open up the grooves.

The flanges 8, 8 are provided at the ends 310b, 320b of the curved pipes 31, 32. They comprise a flat plate having a constant thickness, and have the following configuration; namely: as illustrated in FIG. 6, the flanges 8, 8 have an arc-shaped flange portion 8h which expands along the lower half of the ends of the 310b, 320b of the curved pipes 31, 32. Further, as illustrated in FIG. 7, the flanges 8, 8 have guide portions 8g, 8g which extend in parallel upwardly in the drawing up to positions which are placed above the top of the ends 310b, 320b. The right and left guide portions 8g, 8g are connected integrally to the ends 310b, 320b of the curved pipes 31b, 32b on their inner peripheries. Furthermore, the right and left guide portions 8g, 8g are connected integrally with the ends 310b, 320b of the curved pipes 31b, 32b at around their top ends. Moreover, the right and left guide portions 8g, 8g include arm-like portions 81, 81 which expand so as to taper from wide to narrow in the right and left directions away from their top ends.

Hereinafter, the assembling operation of the inner pipe 3b within the box-shaped member 1 will be explained with reference to FIG. 6. First, the flanges 8, 8 provided on the opposed ends 310b, 320b of the inner pipe 3b are fitted into the guide grooves 9, 9 provided on the wall surfaces 13, 14, and are engaged therewith. For example, as illustrated in FIG. 7, the guide portions 9g, 9g of the guide grooves 9, 9 engage with the guide portions 8g, 8g of the flanges 8, 8 to guide them. The flange portion 8h of the flanges 8, 8 slides on the guide portions 9g, 9g, and arrives at a position where it contacts with the holding portion 9h of the guide grooves 9, 9 to engage therewith. During this assembling operation, the right and left arm-like portions 81, 81 of the flanges 8, 8 deform elastically to bend into the inner side of the expansion chamber "A". When the arm-like portions 81, 81 go over the fixing members 90, 90 which project from the wall surfaces 13, 14, the deformation of the arm-like portions 81, 81 is canceled to restore their original configuration. Accordingly, the top end surfaces of the arm like portions 81, 81 contact with the bottom end surfaces of the fixing members 90, 90. Once the inner pipe 3b is assembled within the box-shaped member 1, the arm-like portions 81, 81 of the flanges 8, 8 thus engage with the fixing members 90, 90. Consequently, the flanges 8, 8 are retained in the guide grooves 9, 9. If desired, an adhesive can be applied to the connections between the box-shaped member 1 and the inner pipe 3b (e.g., the end surfaces of the flanges 8, 8). In particular, it is preferred to slightly taper the top end surfaces of the fixing portions 90, 90 with respect to the wall surfaces 13, 14. If such is the case, the arm-like portions 81, 81 of the flanges 8, 8 can be fitted smoothly between the lower end surfaces of the fixing members 90, 90 and the top ends of the guiding portions 9g of the guide grooves 9, 9.

When the inner pipe 3b is thus assembled within the box shaped member 1, the ends 310b, 320b of the curved pipes 31b, 32b which constitute the inner pipe 3b are disposed so as to face accurately with the communication ports 16, 17, and they are connected therewith to communicate the inner pipe 3b with the communication tubular member 5b and the straight tubular member 2b. As a result, in the Third Embodiment of the present muffler, the inner surfaces of the inner pipe 3b, the communication tubular member 5b and the straight tubular member 2b are connected continuously with each other, thereby forming a smooth fluid passage.

In FIG. 7, there are illustrated spaces between the fixing members 90, 90 and the arm-like portions 81, 81. In FIG. 8, there are illustrated spaces between the guide groove 9 and the flange 8. Note that, however, these spaces are illustrated for identifying the component elements clearly. In fact, there are provided clearances merely required for assembly. Further, in order to ease the assembling operations, the flanges 8, 8 are tapered slightly in their thickness-wise direction, and the guide grooves 9, 9 are tapered slightly in their groove-width-wise direction. Furthermore, for serving a similar purpose, component members constituting the flanges 8, 8 and the guide grooves 9, 9 are rounded at their outer corners. Moreover, in order to inhibit stresses from concentrating as well as to make forming operations easier, the component members constituting the flanges 8, 8 and the guide grooves 9, 9 are rounded at their inner corners.

By carrying out the assembling operations as described above, the inner pipe 3b is fixed within the box-shaped member 1. Finally, a cover plate (not shown) is put on the box-shaped member 1, and is bonded to the entire outer peripheral rim of the side walls around the box-shaped member 1 and the rim of the partition wall 21b by welding or by means of adhesive. This cover plate comprises a flat plate whose configuration corresponds with the entire outer peripheral rim of the side walls around the box-shaped member 1. The cover plate is provided with grooves at the portions where it contacts with the entire outer peripheral rim of the side walls around the box-shaped member 1, and the rim of the partition wall 21b, and the grooves are capable of engaging therewith. Thus, the cover plate is connected air-tightly and firmly with the box-shaped member 1. If the flexural rigidity of the inner pipe 3b may be of concern, a supporting-pillar member can be provided with the cover plate at the position which corresponds to a dent of one of the connecting members 34b. The supporting-pillar member is capable of engaging with the dent of the connecting member 34b. With this extra arrangement, the free end of the supporting pillar member and the dent of the connecting member 34b can be fixed with each other, for instance, by means of adhesive. As a result, the inner pipe 3b can be firmly supported at its intermediate portion in the expansion chamber "A". Alternatively, a supporting-pillar member can be disposed on the bottom surface of the box-shaped member 1 so as to project upward in the expansion chamber "A". Thus, the inner pipe 3b can be supported at its intermediate portion.

The thus constructed Third Embodiment of the present muffler operates and effects advantages as follows. First, since a plurality of the separations 6b to be disposed in the expansion chamber "A" are formed already in the inner pipe 3b, the separations 6b are formed precisely in advance. Consequently, it is unnecessary to adjust the interval of the separations 6b and align them axially. As a result, the axial line does not deviate significantly at the separations 6b, and unnecessary increment in the fluid passage resistance hardly arises. Moreover, the size of the separations 6b is determined accurately in advance, the expansion chamber "A" can function as designed.

Second, the guide grooves 9, 9 engage with and guide the flanges 8, 8 provided on the ends 310b, 320b of the inner tube 3b to hold the inner pipe 3b at an appropriate position in the expansion chamber "A". Additionally, the fixing members 90, 90 inhibit the inner pipe 3b from coming-off the box-shaped member 1. Accordingly, the assembling operation of the inner pipe 3b within the box-shaped member 1 is simplified so that it can be carried out by snap action. In particular, the flanges 8, 8 provided on the ends 310b, 320b of the inner tube 3b engage with the guide grooves 9, 9, and thereby the ends 310b, 320b of the inner tube 3b are held and fixed precisely and firmly at predetermined positions as designed on the wall surfaces 13, 14 of the box-shaped member 1. Thus, a smooth fluid passage can be formed in the Third Embodiment of the present muffler. Hence, there scarcely arises unnecessary increment in the fluid passage resistance.

All in all, the Third Embodiment of the present muffler has reduced fluid passage resistance, and can exhibit its superb performance stably. Moreover, this muffler can be manufactured at less expensive costs, because the man-hour requirements for its assembly are reduced.

Note that, as described above, the guide grooves 9, 9 operate as guide means which is adapted for guiding the ends 310b, 320b of the inner pipe 3b to the communication ports 16, 17 formed through the wall surfaces 13, 14 and for contacting them therewith. The guide means is not limited to the guide grooves 9, 9. For example, the guide means can be a strip shaped plate which is formed on the wall surfaces 13, 14 so as to project therefrom in a letter "U"-shape or in a semi-arc shape. If such is the case, the flanges 8, 8 can be removed from the inner pipe 3b, and the fixing members 90, 90 can be a mere projection disposed on the wall surfaces 13, 14. When the inner pipe 3b and the fixing members 90, 90 are thus constructed, it is possible to complete the assembly of the inner pipe 3b within the box-shaped member 1 by elastically deforming the inner pipe 3b with the projection and by fitting it over the projections.

Also note that, in order to help understand the present invention with ease, the inner pipe 3b is made of a plurality of component elements (e.g., curved tubes 31b, 32b, etc.). The present invention is not limited to this construction. For instance, by appropriately devising the manufacturing processes, it is possible to integrally mold the inner pipe 3b with synthetic resin, or the like. Similarly, by properly arranging the configurations of the straight tubular member 2b and the box-shaped member 1 forming the resonator chamber "B," and so on, it is possible to integrally mold them with synthetic resin, or the like. It is preferred to employ these arrangements which contribute to considerable cost reduction in mass production.

In addition, depending on installation space within vehicle, curved pipes can constitute the communication tubular member 5b and the straight tubular member portion 2b. The fluid passage formed in the inner pipe 3b, the communication tubular member 5b and the straight tubular member portion 2b is not limited to a circular cross-section. For example, the fluid passage can be an arbitrary cross-section like ellipse, rectangle, and so on. Likewise, the cross-sectional area cannot necessarily be constant.

Fourth Embodiment

A Fourth Embodiment of a muffler according to the present invention will be hereinafter described with references to FIGS. 10 through 12.

Figure 10:
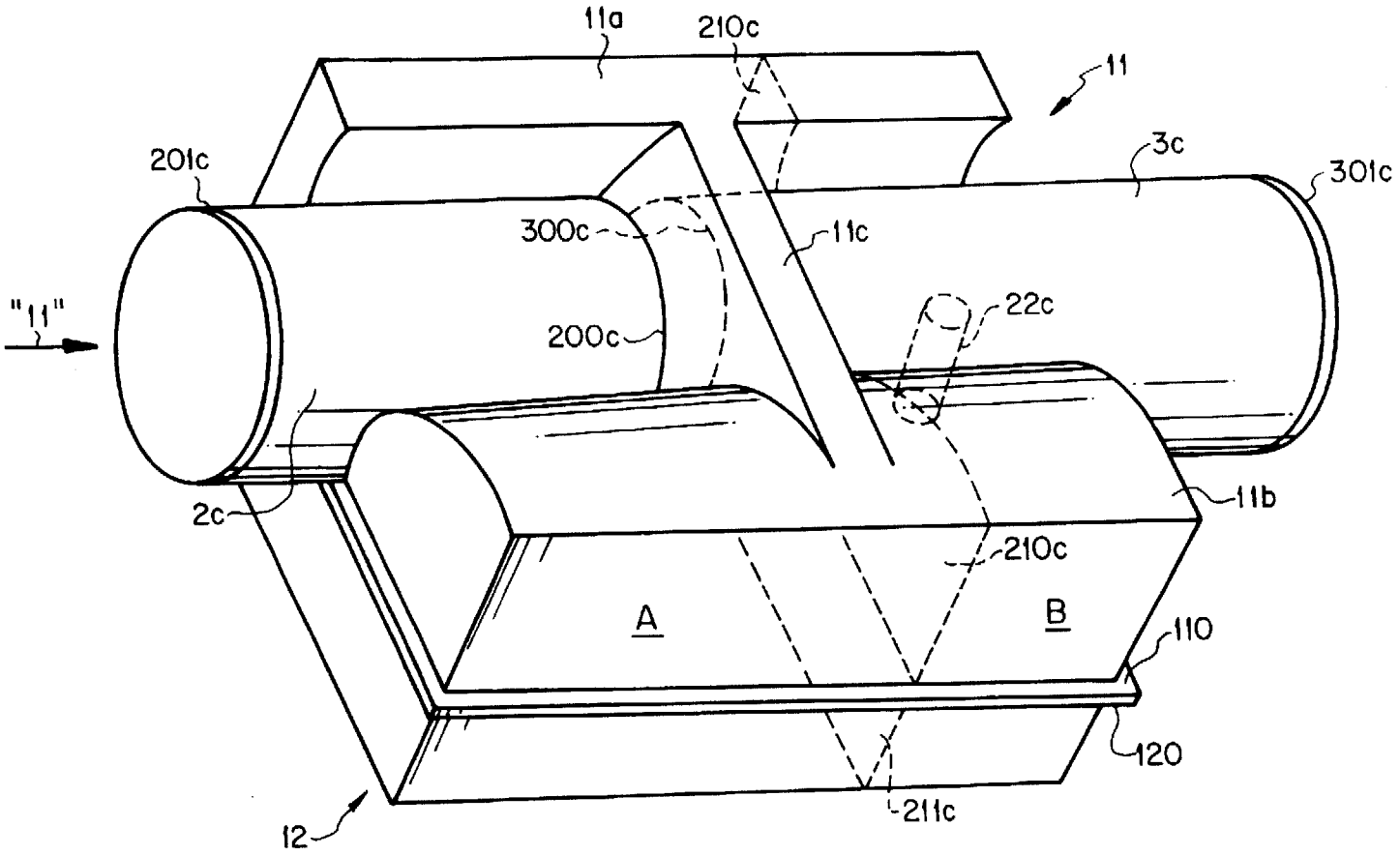
FIG. 10 is a perspective view illustrating a Fourth Embodiment of a muffler according to the present invention.

As illustrated in FIG. 10, the Fourth Embodiment of the present muffler comprises a body 11, and an enclosure member 12. The body 11 includes case portions 11a, 11b, a first tubular portion 2c, and a second tubular portion 3c. The case portions 11*a*, 11*b* define an expansion chamber "A" and a resonator chamber "B" therein, when coupled to the enclosure member, and have a separator wall 210*c* which separates the expansion chamber "A" from the resonator chamber "B". The first tubular portion 2*c* is molded integrally with the case portions 11*a*, 11*b*, and has opposite ends 200*c*, 201*c*. One end 200*c* is opened to the expansion chamber "A", and the other end 201*c* is opened to outside of the body 11. The second tubular portion 3*c* is molded integrally with the case portions 11*a*, 11*b*, and has a wall exposed to the resonator chamber "B" and opposite opened ends 300*c*, 301*c*. The wall is provided with a resonator port 22*c*. One end 300*c* is disposed so as to face the one end 200*c* of the first tubular portion 2*c* with a space therebetween, and is opened to the expansion chamber "A". The other end 301*c* is opened to the outside. The enclosure member 12 is mounted onto the body 11, and defines the expansion chamber "A" and the resonator chamber "B".

Thus, the Fourth Embodiment of the present muffler comprises two component elements, i.e., the body 11 and the enclosure member 12.

The body 12 includes the first tubular portion 2*c*, the second tubular portion 3*c*, and the case portions 11*a*, 11*b*, and is molded integrally. The first tubular portion 2*c* and the second tubular portion 3*c* are disposed so as to face each other. The case portions 11*a*, 11*b* are disposed on both sides of the first tubular portion 2*c* and the second tubular portion 3*c*.

The first tubular portion 2*c* and the second tubular portion 3*c* are straight-tube-shaped portions which have a circular cross-section, and are disposed coaxially so as to define a space therebetween. Thus, between their facing opened ends 200*c*, 300*c*, they form a space which is opened to the expansion chamber "A". On the other hand, the other opened end 201*c* of the first tubular portion 2*c* and the other opened end 3O*ac* of the second tubular portion 3*c* are disposed oppositely away from each other. The other opened ends 201*c*, 301*c* are provided with a convexed-portion on their outer periphery for engagement with an inlet air system, and are opened to the outside. The second tubular portion 30 has the resonator port 22*c* on its cylindrical wall which is disposed between side walls of the case portions 11*a*, 11*b*. The case portions 11*a*, 11*b* herein mean their parts which lie between the one opened end 300*c* and the other opened end 301*c* of the second tubular portion 3*c*, and which form the resonator chamber "B" therein. The resonator port 22*c* is formed as a tube which is opened downwardly.

The case portions 11*a*, 11*b* are disposed on both sides of the first tubular portion 2*c* and the second tubular portion 3*c*, and are formed as a vessel which is opened downwardly. Their inner space is divided by the separator wall 210*c* which is disposed between the one end 300*c*and the resonator port 22*c* of the second tubular portion 3*c*. On the side of the first tubular portion 2*c*, there is formed the expansion chamber "A". On the side of the resonator port 22*c* of the second tubular portion 3*c*, there is formed the resonator chamber "B".

Figure 11:
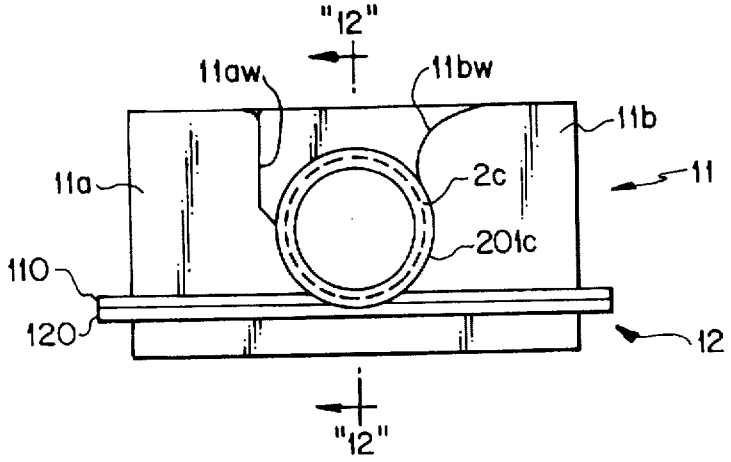
FIG. 11 is a side view of the Fourth Embodiment of the present muffler viewed in the direction of arrow 11 of FIG. 10.

As illustrated in FIG. 11, inward walls 11*aw*, 11*bw* of the case portions 11*a*, 11*b* rise up from both surfaces of the first tubular portion 2*c* and the second tubular portion 3*c*. The inward walls 11*aw*, 11*bw* connect with lower walls, which are shared by the lower half tubular walls of the first tubular portion 2*c* and the second tubular portion 3*c*, respectively. On the other sides (i.e., on the outer side), the inward walls 11*aw*, 11*bw* connect with outer walls which form top and side surfaces of the case portions 11*a*, 11*b*, and extend continuously to bonding rims 110, 120 of the body 11 and the enclosure member 12. Moreover, as can be seen from FIG. 12, the case portions 11*a*, 11*b* have an outer wall on one of their sides. The outer wall contacts virtually perpendicularly with an outer periphery of the first tubular portion 2*c* around the opened end 300*c* thereof. Thus, an inner space is formed in the case portions 11*a*, 11*b*.

As illustrated in FIGS. 10 and 11, the enclosure member 12 is formed as a flat rectangle-shaped vessel, and has an inner space generally rectangular parallelepiped. The inner space is divided into the expansion chamber "A" and the resonator chamber "B" by a separator wall 211*c* which contacts with the separator wall 210*c* of the body 11.

The body 11 and the enclosure member 12 are integrally made of synthetic resin respectively, and are assembled together by superimposing the bonding rims 110, 120 with each other and by welding them together. Thus, they constitute the Fourth Embodiment of the present muffler which is provided with the expansion chamber "A" and the resonator chamber "B".

Figure 12:
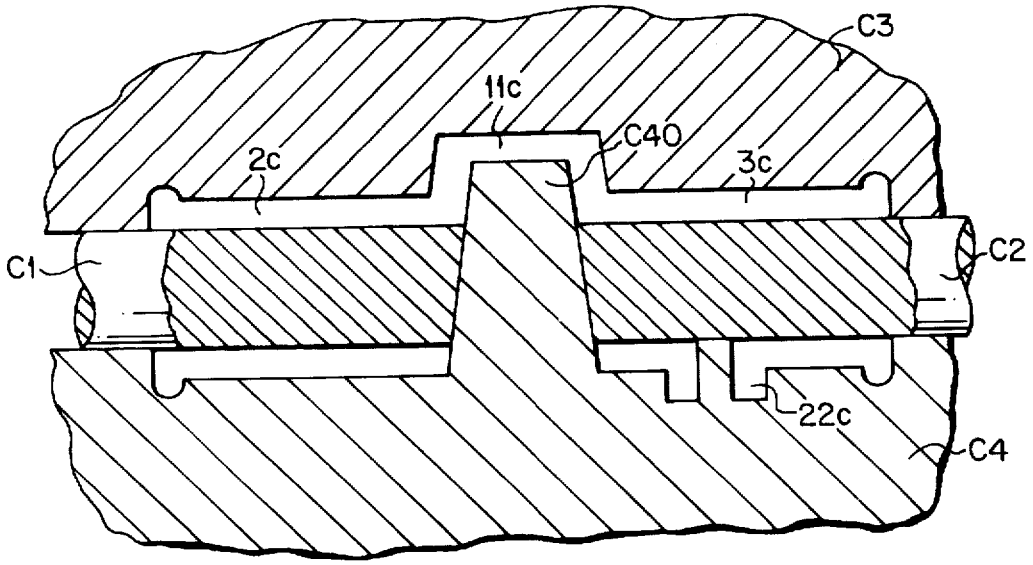
FIG. 12 is a cross-sectional view illustrating a mold for molding a cross-section of the Fourth Embodiment of the present muffler taken along line 12-1" of FIG. 11.

When integrally molding the body 11 out of synthetic resin, it can be molded integrally by using a mold, for example, as illustrated in FIG. 12. The drawing shows a cross-section of the mold for molding a vertical cross-section of the body 11 which is taken along the axis of the first and second tubular portions 2*c*, 3*c*. Specifically, the mold comprises an upper mold "C3", a lower mold "C4", tubular insert molds "C1", "C2". The upper mold "C3" is adapted for molding the upper half of the body 11, and has a concaved portion. The lower mold "C4" is adapted for molding the lower half of the body 11, faces the upper mold "C3", and has a convexed portion "C40". The insert molds "C1", "C2" are adapted for molding the inner peripheries of the first tubular portion 2*c* and the second tubular portion 3*c*, respectively. When carrying out the molding operation, the upper mold "C3" and the lower mold "C4" contact each other, and thereafter the insert molds "C1", "C2" are inserted coaxially through the opposite side surfaces of the upper and lower molds "C3", "C4". The facing end surfaces of the insert molds "C1", "C2" are brought into close contact with side surfaces of the convexed member "C40" of the lower mold "C4", thereby forming the opened ends 200*c*, 300*c* of the first and second tubular members 2*c*, 3*c* which are opened to the expansion chamber "A". The convexed portion "C40" of the lower mold "C4" is adapted for molding the case portions connector 11*c*.

Thus, the body 11 can be manufactured in which the first tubular portion 2*c*, the second tubular portion 3*c*, the case portions 11*a*, 11*b*, and a case-portions connector 11*c* are molded integrally. Note that the first tubular portion 2*c* and the second tubular portion 3*c* are disposed coaxially so as to face each other, that the case portions 11*a*, 11*b* form the expansion chamber "A" and the resonator chamber "B" within their inner spaces, and that the case-portions connector 11*c* connects the case portions 11*a*, 11*b*.

As having been described so far, in the Fourth Embodiment of the present muffler, the first tubular portion 2*c* and the second tubular portion 3*c* face with each other so as to form the space, which is opened to the expansion chamber "A", therebetween, and they are molded integrally with the body 11 as parts thereof. Although it is unnecessary to adjust the interval of the space opened to the expansion chamber "A", and to align the first and second tubular portions 2*c*, 3*c* axially, it is guaranteed that the space is formed precisely. Moreover, since the Fourth Embodiment comprises two component elements (i.e., the body 11 and the cover 12), it is not needed to assemble an independent pipe member so as to face the first tubular portion 2*c* and to form the opening. Thus, the assembling operation is simplified extremely. In addition, since only the bonding rims 110, 120 of the body 11 and the enclosure member 12 constitute a connection, an advantage is produced in that the Fourth Embodiment is extremely unlikely to suffer from failures which result from the breakage at the connection.

All in all, the Fourth Embodiment of the present muffler including the expansion chamber "A" and the resonator chamber "B" exhibits reduced fluid passage resistance, and performs superb noise reduction. Moreover, it is manufactured not only reliably but also at reduced cost. In particular, in the Fourth Embodiment, the assembly man-hour requirements are reduced to minimum, and accordingly the cost-reduction advantage is effected remarkably in mass production.

Turning back to FIG. 11, in the Fourth Embodiment of the present muffler, the inward walls 11*aw* 11*bw* rise up from the side surfaces of the first tubular portion 2*c* and the second tubular portion 3*c*. Note that the inward wall 11*aw* is formed so as to rise up perpendicularly from the side surfaces of the first and second tubular portions 2*c*, 3*c*, and that the inward wall 11*bw* is formed so as to rise up tangentially from the side surfaces of the first and second tubular portions 2*c*, 3*c*. The inward wall 11*aw* exemplifies a construction that puts emphasis on the readily-machinable upper mold "3C". The inward wall 11*bw* exemplifies a construction that puts emphasis on the enlargement of the expansion chamber "A", which is formed in the case portion 11*b*, for better noise reduction. Therefore, when actually manufacturing the Fourth Embodiment, it is preferred to coordinate to either of the constructions (e.g., the inward wall 11*aw* or the inward wall 11*bw*).

Further, the space, which is formed by the opened ends 200*c*, 300*c* of the facing first and second tubular portions 2*c*, 3*c* within the case-portions connector 11*c*, can produce the noise-reduction effect operatively when it is opened by an angle over a half or more of the entire periphery. Accordingly, due to manufacturing convenience (e.g., when it is needed to reduce the height of the case-portions connector 11*c*), it is possible to form an opening which is not opened over the entire periphery.

Furthermore, it is not always necessary to form the first tubular portion 2*c* and the second tubular portion 3*c* as a straight tube shape. Even when they are formed as a curved tube having a predetermined curvatures, it is possible to mold them integrally with the body 11 in the same manner as the Fourth Embodiment of the present muffler. Moreover, the cross-section of the fluid passage formed therein is not limited to a circle, it can be formed as an arbitrary shape, for example, ellipse, rectangle, and so on. The cross-sectional area of the fluid passage can be diminished by using a slightly tapered insert molds "C2" and "C3".

In addition, it is not always necessary that the bonding rims 110, 120 be on a flat plane. If required, it is possible to form them three-dimensionally.

Having now fully described the present invention, it will be apparent to one of ordinary skill in the art that many changes and modifications can be made thereto without departing from the spirit or scope of the present invention as set forth herein including the appended claims.

What is claimed is:

1. A muffler comprising:

a box-shaped member containing an expansion chamber therein and including a plurality of wall surfaces, at least two of said wall surfaces respectively having communication ports formed therein;

an inner pipe including openings at opposite ends thereof, said openings respectively communicating with said communication ports, said ends being coupled to portions of said wall surfaces surrounding said communication ports, a portion of said inner pipe having a separation that is positioned between said opposite ends and communicates with said expansion chamber;

flanges respectively provided at said opposite ends of said inner pipe;

guide grooves respectively disposed on said two of said wall surfaces and respectively positioned to surround at least portions of said communication ports, said guide grooves being constructed and arranged to respectively engage with said flanges and guide said flanges with respect to said communication ports in said wall surfaces during assembly of said muffler; and fixing members disposed on said two of said wall surfaces, said fixing members respectively fixing said openings at opposite ends of said inner pipe on said wall surfaces.

2. A muffler comprising:

a box-shaped member containing an expansion chamber therein and including a plurality of wall surfaces, at least two of said wall surfaces having respective first and second communication ports formed therein;

an inner pipe having opposite ends and being disposed in said box-shaped member, said inner pipe including a fluid passage formed therein between said opposite ends, a portion of said inner pipe having a separation that is positioned between said opposite ends, said separation being constructed and arranged to communicate said fluid passage to said expansion chamber;

said inner pipe including at least first and second curved pipes each having opposite first and second ends, said first end of said first curved pipe facing said first end of said second curved pipe to define said separation therebetween, said separation being disposed in said expansion chamber, said second end of said first curved pipe and said second end of said second curved pipe being connected to portions of said wall surfaces surrounding said first and second communication ports, respectively;

first and second guide members disposed on said wall surfaces and positioned to surround at least portions of said first and second communication ports, respectively, said first and second guide members being constructed and arranged to engage with and guide said second ends of said first and second curved pipes, respectively, relative to said first and second communication ports in said wall surfaces during assembly of said muffler; and first and second fixing members disposed on said wall surfaces so as to fix said second ends of said first and second curved pipes respectively, to said wall surfaces.

3. The muffler according to claim 2, further comprising first and second flanges provided at said second ends of said first and second curved pipes, respectively, wherein said first and second guide members include first and second guide grooves, respectively, said first and second guide grooves being constructed and arranged to engage with said first and second flanges, respectively.

4. The muffler according to claim 2, wherein said box-shaped member contains a resonator chamber neighboring said expansion chamber, and wherein said muffler further comprises:

a communication pipe disposed in said resonator chamber, said communication pipe including opposite opened ends; and a resonator port communicating with said resonator chamber, one of said opposite opened ends of said communication pipe communicating with the outside of said box-shaped member, the other one of said opposite opened ends of said communication pipe communicating with one of said curved pipes connected with said wall surfaces.

* * * * *